US008736897B2

(12) United States Patent
Pierce et al.

(10) Patent No.: US 8,736,897 B2
(45) Date of Patent: May 27, 2014

(54) METHOD FOR PRINTING ADDRESS LABELS USING A SECURE INDICIA PRINTER

(75) Inventors: Jeffrey D. Pierce, Sandy Hook, CT (US); Steven J. Pauly, New Milford, CT (US); Steven M. Kaye, Weston, CT (US)

(73) Assignee: Pitney Bowes Inc., Stamford, CT (US)

( * ) Notice: Subject to any disclaimer, the term of this patent is extended or adjusted under 35 U.S.C. 154(b) by 2063 days.

(21) Appl. No.: 11/513,754

(22) Filed: Aug. 31, 2006

(65) Prior Publication Data

US 2008/0053329 A1 Mar. 6, 2008

(51) Int. Cl.
*B41F 33/00* (2006.01)

(52) U.S. Cl.
USPC ..... 358/1.9; 358/1.2; 358/1.6; 705/401; 705/408; 705/50; 101/484; 347/40; 347/9; 347/208; 400/70

(58) Field of Classification Search
USPC ..... 358/1.13, 453, 1.8, 1.9; 705/50, 408; 710/261; 347/208, 40, 15; 713/1, 100
See application file for complete search history.

(56) References Cited

U.S. PATENT DOCUMENTS 5,028,991 A * 7/1991 Sekizawa et al. ..... 358/537
5,075,780 A * 12/1991 Shibahara ..... 358/3.07
5,258,998 A * 11/1993 Koide ..... 375/220
5,386,303 A * 1/1995 Kihara ..... 358/453
5,793,902 A * 8/1998 Watanabe et al. ..... 382/298
5,889,537 A * 3/1999 Shimada ..... 347/41
5,910,987 A * 6/1999 Ginter et al. ..... 705/52
5,920,684 A * 7/1999 Hastings et al. ..... 358/1.13
6,089,695 A * 7/2000 Takagi et al. ..... 347/40
6,102,592 A * 8/2000 Herbert ..... 400/106
6,145,959 A * 11/2000 Lund et al. ..... 347/40
6,169,608 B1 * 1/2001 Yoshida ..... 358/1.9
6,363,177 B1 * 3/2002 Loce et al. ..... 382/254
6,460,958 B2 * 10/2002 Kubo et al. ..... 347/2
6,469,803 B1 * 10/2002 Kato ..... 358/1.9
6,515,767 B1 * 2/2003 Sakurai ..... 358/1.9
6,550,994 B2 4/2003 Manduley
6,574,000 B1 6/2003 Sansome
6,680,783 B1 1/2004 Pierce et al.
6,811,335 B1 11/2004 Ryan, Jr. et al.
6,832,823 B1 * 12/2004 Askeland et al. ..... 347/14
6,879,333 B2 * 4/2005 Furuyama ..... 347/208
6,902,331 B1 * 6/2005 Raman ..... 400/61
7,029,096 B2 * 4/2006 Weijkamp et al. ..... 347/40
7,033,091 B2 * 4/2006 Nakao ..... 400/76
7,108,344 B2 * 9/2006 Yraceburu et al. ..... 347/9
7,124,117 B1 10/2006 Girardi et al.
7,130,951 B1 * 10/2006 Christie et al. ..... 710/261

(Continued)

*Primary Examiner* — Ashish K Thomas
(74) *Attorney, Agent, or Firm* — Brian A. Lemm; Charles R. Malandra, Jr.; Steven J. Shapiro

(57) ABSTRACT

Printing methods and systems that provide both a secure value label printing mode of operation and a non-secure mode of operation that allows generic printing of non-value items without compromising the security feature of the secure printing mode are described. If the printing system determines the image is a non-secure image such as an address label or other non-value graphic, the printing system utilizes the non-secure mode and disables the use certain printhead elements. In such a system, the enforced print disabled white bands are enforced in non-secure mode such as by actually disabling the print drive mechanism that allows a row to be printed or by populating certain regions of the print buffer with zero values.

10 Claims, 5 Drawing Sheets

(56) References Cited

U.S. PATENT DOCUMENTS

| | | | | |
|---|---|---|---|---|
| 7,207,640 | B2 * | 4/2007 | Garcia Reyero et al. | 347/15 |
| 7,233,930 | B1 * | 6/2007 | Ryan, Jr. | 705/408 |
| 7,292,356 | B2 * | 11/2007 | Otokita | 358/1.13 |
| 7,319,989 | B2 | 1/2008 | Athens et al. | |
| 7,353,213 | B2 | 4/2008 | Ryan, Jr. et al. | |
| 7,383,194 | B2 | 6/2008 | Heiden et al. | |
| 7,483,175 | B2 | 1/2009 | Ryan, Jr. et al. | |
| 7,533,067 | B2 | 5/2009 | Beckstrom et al. | |
| 7,623,263 | B2 * | 11/2009 | Yoshida et al. | 358/1.8 |
| 7,689,518 | B2 | 3/2010 | Bator et al. | |
| 7,733,530 | B2 * | 6/2010 | Ryan et al. | 358/1.9 |
| 7,793,087 | B2 * | 9/2010 | Zenz et al. | 713/1 |
| 7,821,690 | B2 * | 10/2010 | Yamada et al. | 358/527 |
| 8,269,995 | B2 * | 9/2012 | Niitsuma | 358/1.14 |
| 8,506,062 | B2 * | 8/2013 | Xu | 347/86 |
| 2004/0024710 | A1 * | 2/2004 | Fernando et al. | 705/50 |
| 2005/0093901 | A1 * | 5/2005 | Yraceburu et al. | 347/9 |
| 2006/0004964 | A1 * | 1/2006 | Conti et al. | 711/136 |
| 2006/0212945 | A1 * | 9/2006 | Donlin et al. | 726/29 |
| 2007/0062402 | A1 | 3/2007 | Ryan, Jr. et al. | |
| 2008/0005042 | A1 * | 1/2008 | Ryan et al. | 705/408 |
| 2009/0091800 | A1 | 4/2009 | Ryan, Jr. et al. | |

* cited by examiner

METHOD FOR PRINTING ADDRESS LABELS USING A SECURE INDICIA PRINTER

CROSS-REFERENCE TO RELATED APPLICATIONS

This application is related to commonly owned, co-pending patent application Ser. No. 11/228,597, entitled "Method and System for Printing Secure Value Documents and Non-Secure Documents Utilizing the Same Printing Device," filed Sep. 16, 2005, which is incorporated herein by reference.

FIELD OF THE INVENTION

The illustrative embodiments of the present application relate generally to printing, and more particularly to methods and systems for printing secure value documents such as postage labels and non-secure documents utilizing the same printer such as a personal postage stamp printer.

BACKGROUND OF THE INVENTION

Secure printing systems are often utilized when printing secure value documents such as postage, tickets and money orders. Since such documents may have substantial cash value, there exists a continuing problem of preventing the copying of such documents to generate fraudulent documents. Several different types of security features are used to secure such documents. In postage printing systems, 2 dimensional barcodes may be used to securely carry information used as proof of postage payment during mail processing. A DATAMATRIX barcode may be used and as such the postage printer will print a 2D DATAMATRIX barcode to create a secure indicium as evidence of postage payment.

Since the security features enable the detection of copies of the secure value documents, it is necessary to ensure that the secure printing systems themselves cannot be used to print fraudulent images which contain the security features. It is therefore necessary to control the source of the images being printed by the secure printing systems, thereby preventing a dishonest person from providing a fraudulent image, e.g., a counterfeit postage indicium, ticket, money order or the like, to the secure printing system, which will print the security features in the fraudulent image, such that it appears legitimate. As a result, such secure printing systems are single purpose devices, i.e., they can only be used to print value documents from a secure source and cannot be used to print any other types of images. This restriction limits the usefulness of such secure printing systems. Personal postage stamp printers have been proposed. With such printers, postal customers, after prepayment of postage, will be allowed to print adhesive postage stamps. The postal customers will be permitted to create or supply a custom image to be incorporated as part of the postage stamps. For example, a postage label printer may be able to print secure postage labels with custom images, but not other non-secure text or graphics since that might allow fraudulent copies of valid postage indicia to be printed.

Personal postage stamp printers may utilize direct contact thermal printhead technology. Thermal printheads are available from several companies including Kyocera Industrial Ceramics Corp. of Vancouver, Wash. and Mitsubishi Electric of Irvine, Calif. Such printheads are available in a variety of sizes and geometric configurations and may be purchased in custom configurations including those having width of approximately one inch. In such printers, the printheads are typically designed to produce heat using thermal printhead heating elements in order to activate thermal media such as a thermal media label stock. Such thermal media is often gray scale media and the elements are heated to higher levels to produce a darker gray output on the thermal media label stock. The thermal printhead typically includes a linear array of resistive heating elements that are brought to increased temperatures using increased drive current. The thermal media passes over the linear array and portions of the media are activated due to the heat present at each heater element.

Thus, there exists a need for a printing system that can be used to print both secure value documents and non-secure documents while ensuring that fraudulent copies of secure value documents printed by the printing system can be prevented.

SUMMARY

The illustrative embodiments of the present application describe printing methods and systems that provide both a secure value label printing mode of operation and a non-secure mode of operation that allows generic printing of non-value items without compromising the security feature of the secure printing mode.

According to illustrative embodiments of the invention, the printing system determines if the image to be printed is a secure image or non-secure image. If the image is a secure image such as a personal postage label including a custom image portion and an indicium portion having a barcode, the printing system utilizes the secure mode and enables the use of the full label width of the printhead array. If the printing system determines the image is a non-secure image such as an address label or other non-value graphic, the printing system utilizes the non-secure mode and disables the use certain printhead elements. In such a system, the enforced print disabled regions or "white bands" are enforced in non-secure mode such as by actually disabling the print drive mechanism that allows a row to be printed.

In at least one illustrative configuration, the non-secure mode disables certain portions of the printhead that are required to print a valid secure image such as a properly encoded 2D DATAMATRIX barcode. The disabled portions may correspond to data modules, or the "timing" mark or "L finder" mark in the barcode that is required for barcode readability.

In at least one illustrative configuration, the non-secure mode pads certain regions of the print image buffer with zeros to disable printing in those regions. Each disabled region is a subset of the total image region. There may be one or more disabled regions defined as a set of disabled region configurations sufficient to defeat a required value image format such as a DATAMATRIX barcode. Additionally, in certain aspects the plurality of sets of disabled regions may be presented to the user as alternative non-secure disabled region templates so that the user may select an appropriate non-secure template having a set of disabled regions appropriate for the non-secure print application. In another embodiment, the system controller interrogates a potential non-secure print image to determine if it is compatible with at least one of the set of disabled region templates, and if so it allows the non-secure print using that template. In such cases, the system fills certain sections of the print buffer of the printer controller for those disabled areas with a white value so that they do not print.

In at least one other illustrative configuration, the non-secure mode enforces one or more text only region and one or more graphics regions wherein the graphics regions are too small to accommodate a valid value image. In at least one other illustrative configuration, the co-located processor that creates the non-secure image embeds the disabled regions in the non-secure image before sending it to the printer for a non-secure print.

BRIEF DESCRIPTION OF THE DRAWINGS

The accompanying drawings illustrate embodiments of the invention, and together with the general description given above and the detailed description given below, serve to explain the principles of the invention. As shown throughout the drawings, like reference numerals designate like or corresponding parts.

DETAILED DESCRIPTION

The illustrative embodiments of the present application describe printer systems and methods that provide both a secure printing mode and a non-secure printing mode using the same printing device. In the secure mode, a value mark must be printed in the secure image and it must be compatible with the particular secure mark format to be a valid secure value image. For example, 2D barcode symbologies are known and have published formatting rules for valid readable barcodes.

Barcode symbologies used in value printing applications typically have redundancy features to tolerate some errors in printing or other distortion, but will also have areas that are more sensitive to errors. As an illustrative example, the 2D DATAMATRIX barcode often used in secure postage value printing systems has a required format. The barcode may be scaled to a certain extent and still be read and it may have certain cells distorted and be readable. However, certain regions such as the "L finder" and "timing" regions are more susceptible to errors and can be used to render an otherwise valid barcode unreadable.

The illustrative embodiments described herein show a thermal postage printer, but other printing technologies and other value printing applications may be used with the teachings of the application. In a secure mode, the secure image includes at least one value mark. In the non-secure mode described herein, disabled regions are defined and enforced on the image such that the printing of a valid value mark would not be possible in the non-secure mode.

Figure 1:
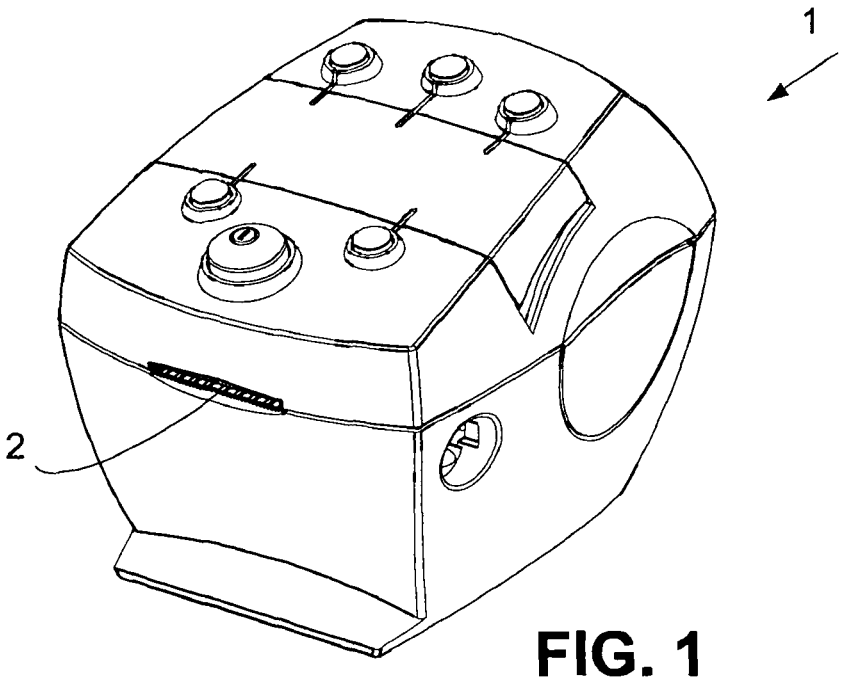
FIG. 1 is a generalized plan view of a direct contact thermal media printer used for printing custom postage labels as evidence of postage payment according to an embodiment of the present application.

Referring to FIG. 1, a generalized plan view of a thermal media personalized postage label printer 1 used for printing custom postage labels as evidence of postage payment according to an embodiment of the present application is shown. The labels are printed and then fed through port 2. As described herein, the printer may be used in a secure mode and in a non-secure mode and may be connected to a co-located processor such as a host Personal Computer connected through a USB communications channel. The Printer 1 could be, for example, a system for printing postage as well as other images, e.g., corporate logos, product labels, etc.

Figure 2:
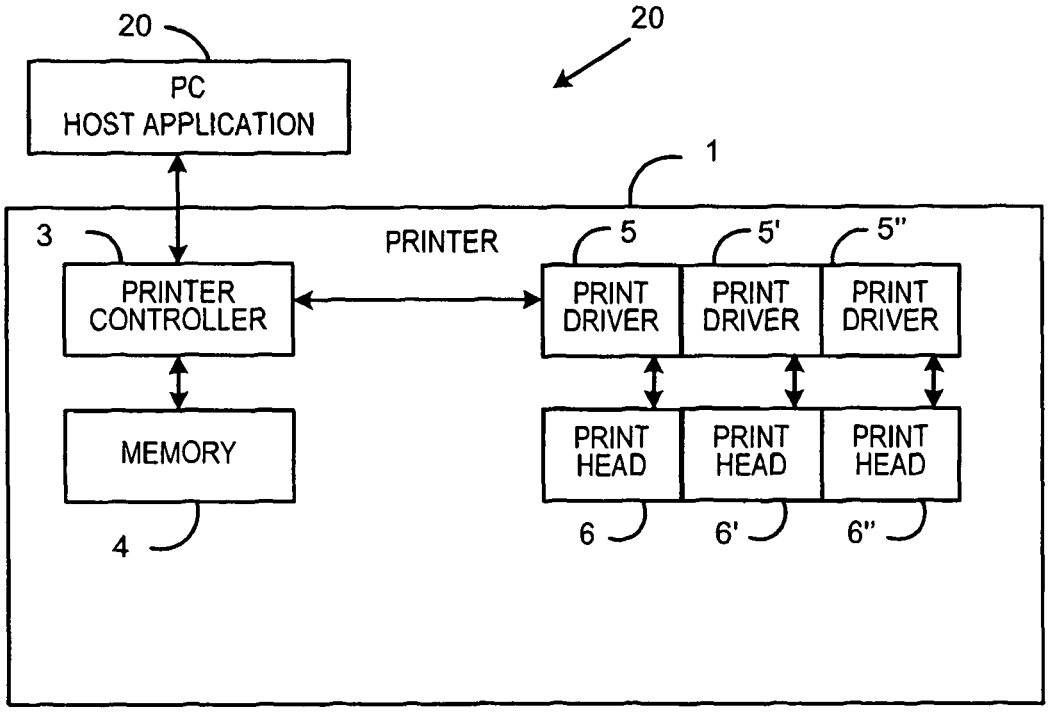
FIG. 2 is a schematic diagram of certain control and electrical elements of the thermal media printer of FIG. 1 along with a host system according to an embodiment of the present application.

Referring to FIG. 2, certain control and electrical elements of the thermal media printer 1 along with a host PC 20 are shown. The printing system 20 includes a host PC 20 running a printing application and connected to the printer 1 such as by a USB communications channel. System 20 includes a printer 1 coupled to one or more host systems and applications 20 (only one shown in FIG. 2 for clarity). The host application 20 may or may not be designed for use in controlling the printer during secure printing mode. Typically, there will be a host application 20 dedicated to the value printing function, but the printer may print in a secure value printing mode without being attached to the host PC or application 20. In certain embodiments of the non-secure printing mode, the printer 1 does not authenticate the application 20 as a secure printing application and then switches to a non-secure mode such that a non-secure application such as a word processor could then utilize the printer 1 in a non-secure printing mode.

The printer 1 includes a printer controller 3, such as, for example, a special purpose processor or ASIC, to control operation of the printer 1. The ASIC 3 includes a processing core and logic specific to the secure value printing mode. A memory device 4 is included for storing instruction data and application data and will include a print buffer so that rendered print graphics may then be sent to the print drivers 5, 5', 5" for printing using the thermal printhead elements 6, 6', 6".

The printer controller handles any thermal printing adjustments required for the print data. The printhead 6. 6', 6" is typically a linear array of thermal heating elements. The print drivers 5, 5', 5" each drive one or more printhead elements and typically will be configured to drive 64 elements of the 256 element array. The printer controller 3 may be used to provide the logic to switch between the secure printing mode and the non-secure printing mode. For example, when the printer 1 is not connected to a collocated processor, it may be assumed that the system can only be used for the value printing functions. Accordingly, in an illustrative embodiment in stand alone mode, the printer 1 may only be used in secure mode for printing custom postage labels. In a connected configuration, if the collocated processor is running an authenticated postage printing application, the printer controller 3 allows the collocated processor 20 to run in secure mode. However, if the collocated processor is running a non-authenticated application, the printer allows only non-secure mode printing.

In an alternative embodiment, even the non-secure applications must be authenticated and then the printer controller 3 will trust the collocated processor and application to enforce the required restrictions for the enabled non-secure print mode.

Figure 3:
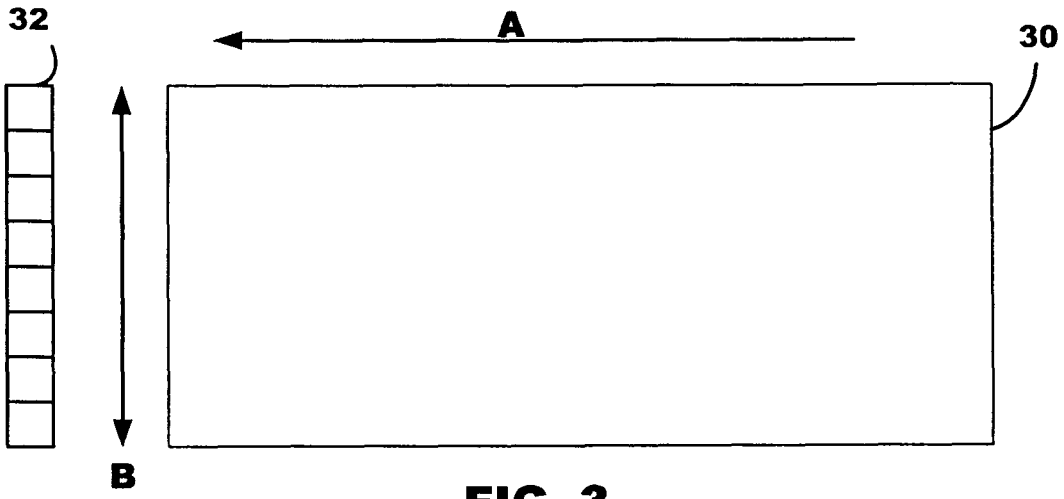
FIG. 3 is a schematic top view of an illustrative blank thermal media label and a thermal printhead array according to an illustrative embodiment of the present application.

Referring to FIG. 3, a schematic side view of an illustrative thermal printhead according to an illustrative embodiment of the present application is shown. Thermal printhead 32 includes an array of 256 heating elements. The thermal media 30 is fed across the direct contact thermal printhead 32 in direction A across the width of the printhead B. As the printhead is heated, the thermal media is activated in those areas.

Figure 4A:
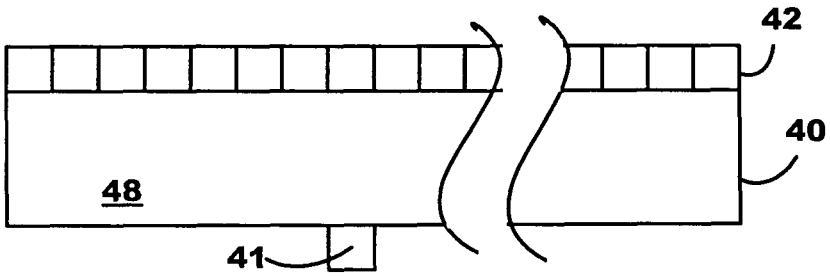
FIG. 4A is a schematic side view of an illustrative thermal printhead according to an illustrative embodiment of the present application.

Referring to FIG. 4A, a schematic side view of an illustrative thermal printhead according to an illustrative embodiment of the present application is shown. Thermal printhead 48 includes an array of 256 heating elements 42 and a heatsink 40. The printhead also includes a thermistor 41 that is used for measuring the temperature of the device. The thermal printer typically includes a printer controller for controlling the drive circuits that heat the array of heating elements. The printer controller may include a generic microcontroller that is programmed to perform printer controller functions or a custom ASIC as shown in FIG. 2. In the illustrative embodiment, the thermal printhead is 256 elements wide in a 200 elements per inch configuration. The center 200 elements are utilized for a print zone that is 1 inch or 200 elements wide. The 28 elements on each outside of the array are not used and in one configuration, the print buffer populates those bits with zero values. Alternatively, the drive mechanism for those elements may be omitted or disconnected.

Figure 4B:
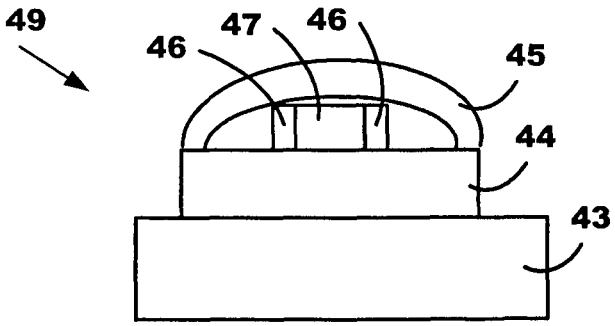
FIG. 4B is a schematic side cutaway view of a thermal printhead heating element according to the illustrative embodiment of the present application shown in FIG. 4A.

Referring to FIG. 4B, a schematic side cutaway view of a thermal printhead heating element as used in thermal printhead 48 is shown. The thermal printhead described is illustrative and could be replaced with other similar printheads such as the Kyocera KSB320BA. A resistive heating element 47 is connected to electrodes 46 that provide a drive current to heat the element 47. A wear layer 45 is placed over the heating element 47 and is used to directly contact the thermal media. The thermal media is typically fed through a paper handling device such as a roller that biases the thermal media into contact with the wear layer 45. The resistive heating element 47 is deposited on a ceramic substrate 44 that is deposited on an aluminum heatsink 43. The heatsink 43 is used for facilitating removal of heat from the heating element 27 after the drive circuit removes the drive current.

Figure 5A:
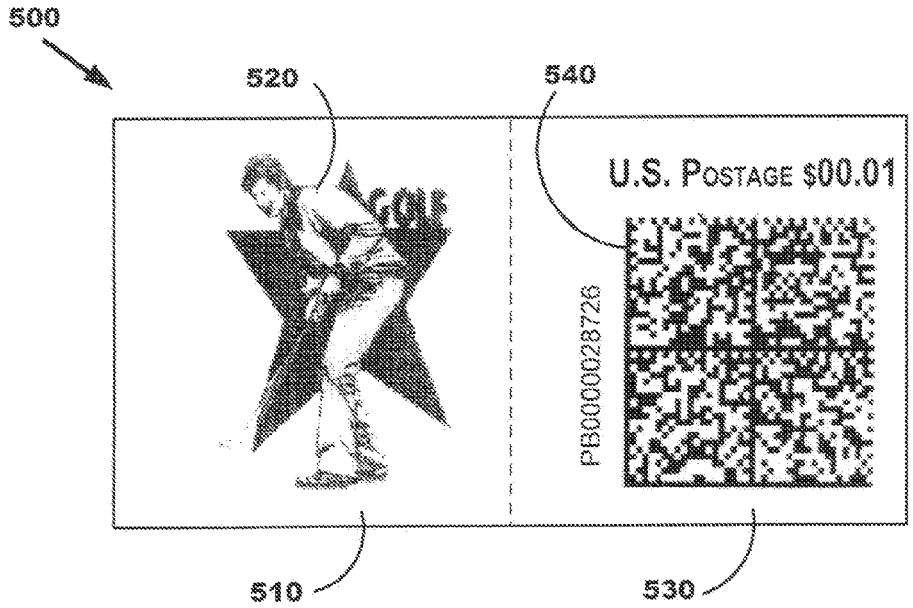
FIG. 5A is a top plan view of an illustrative custom postage label including a custom image label and a postage indicia label according to an illustrative embodiment of the present application printed in secure mode.

Referring to FIG. 5A, a top plan view of an illustrative custom postage label 500 including a custom image label 510 and a postage indicia label 530 according to an illustrative embodiment of the present application printed in secure mode is shown. The secure postage indicium label 530 includes a secure value mark 540. In this illustrative embodiment, the secure value mark is a DATAMATRIX 2D barcode 540. Such a barcode must conform to a specification in order to be read as a valid barcode and therefore be capable of being read as a valid value mark. The custom image portion includes custom graphic 520. The left half of the label includes a custom gray-scale image. The right half of the label includes a postage indicium.

The label media comprises a paper substrate or polypropylene thermal media substrate such as the Mitsubishi K61S-ce 32 level direct gray-scale thermal media. The individual labels 510, 530 are approximately 33.6 mm wide and 33 mm high (including the adhesive backing material as the label media portion that is removed and used as a stamp is approximately 30.2 mm high as shown by the height from scallop to scallop). The thermal media is a gray-scale thermal label that is fed across a thermal printhead that includes a linear array of heating elements. The media has a width that is approximately 1.5 inches wide. The media described is for illustrative purposes. In alternatives, the thermal media may be of a different width as appropriate, may be coated, may be a color media and may be in a different format such as a roll media.

Figure 5B:
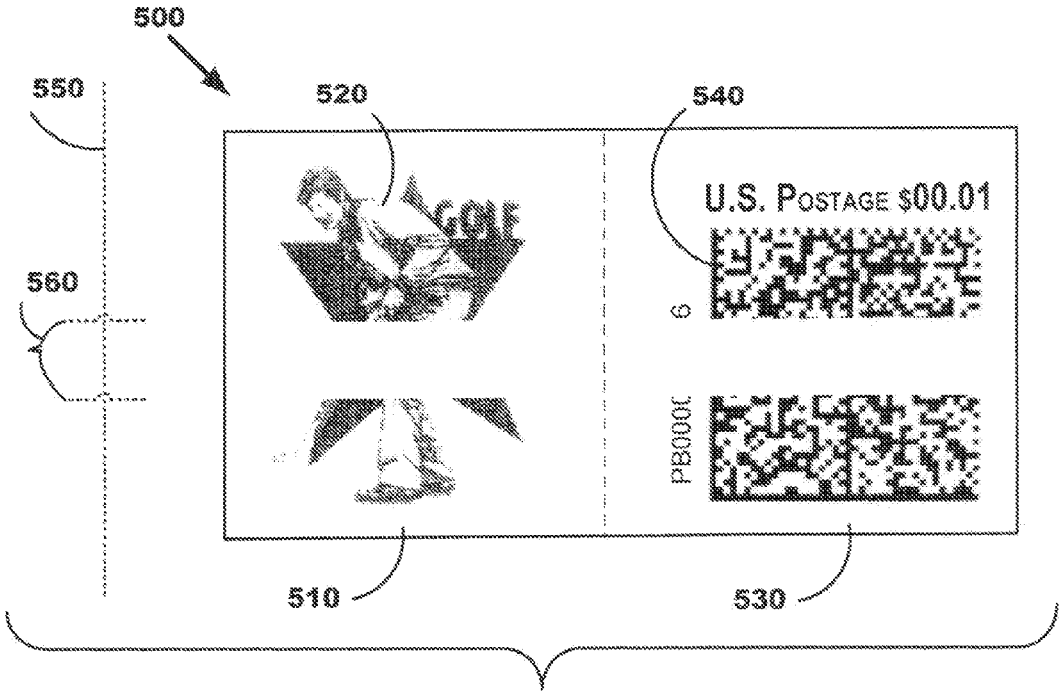
FIG. 5B is a top plan view of an illustrative custom postage label including a custom image label and a postage indicia label according to an illustrative embodiment of the present application printed in non-secure mode.

Referring to FIG. 5B, a top plan view of an illustrative custom postage label 500 including a custom image label 510 and a postage indicia label 530 according to an illustrative embodiment of the present application printed in non-secure mode is shown. The 256 element thermal printhead 550 is shown with an enforced white region 560 shown. The elements of region 560 are disabled in the non-secure mode and cannot print. As can be appreciated, the printed label 500 includes a wide white region 560 that is a subset of the image region of the label. The barcode 540 is missing at least one timing row and will not be readable. Accordingly, the attempt to print a valid value mark in the non-secure mode is defeated by enforcing the disabled white band region.

Alternatively, additional regions may be used to create a set of disabled regions. In yet another alternative, the disabled region may be implemented by forcing a fill of those disabled regions of the print buffer with zero values. As can be appreciated, when using the print buffer forced fill approach, the enforced disabled regions may be sections of the image that are not bands across the entire image such as by regions defined by x-y coordinates of the image.

Two-dimensional bar codes typically utilize a defined encoding format having certain known absolute or relative physical formatting rules and symbologies so that bar code readers can read the bar code so that the embedded information may be decoded. There are many standard Two-dimensional bar codes formats including the DATAMATRIX bar code that have some error checking and redundancy, but may also have regions that are more vulnerable to failure. For example, the DATAMATRIX bar code format includes an "L finder" region and a "timing pattern" region that may be more sensitive to failures than data regions of the bar code. A single damaged or missing thermal element that is located in an area that prints a sensitive region such as the "timing pattern" region may disproportionately negatively affect the accurate readability of the postage value printer meter. Accordingly, the knowledge of the requirements of the valid barcode are used to facilitate the least obstructive enforced disabled regions in a non-secure print mode. As shown here, the disabled region is approximately.

Figure 6A:
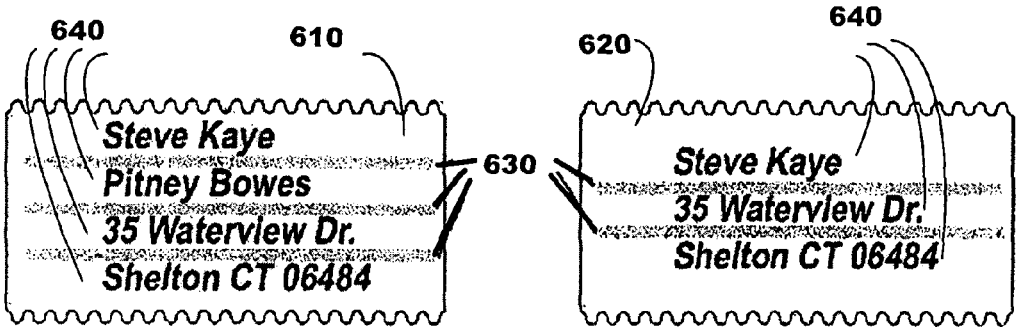
FIG. 6A is a top plan view of two media labels each including enforced white zones printed in a non-secure mode according to an illustrative embodiment of the present application.

Referring to FIG. 6A, a top plan view of two media labels 610, 620 each including enforced white zones 630 printed in a non-secure mode according to an illustrative embodiment of the present application is shown. The embodiments of the present application describe graphic methods to support printing of non value images and text such as address labels using a secure printer in a non-secure mode that defeats that printing of fraudulent revenue blocks or value marks in the non-secure printing mode. In one embodiment, the value protection methods utilize knowledge of the common layout of address labels. Address labels use multiple text lines, segmented with white space. Accordingly, an image format layout can be established to limit printing to the print segments of interest for address labels by enforcing white bands 630 between the lines of text 640.

As can be appreciated, the enforced white bands will preclude the printing of valid DATAMATRIX 2D barcodes and other stamp images in the non-secure print mode. The number and position of the white bands 630 can be varied to permit multiple acceptable formats in the non-secure print mode. For example, label 610 is printed with a first enforced white space template having three enforced white band regions 630. That allows a four line address label having four lines of text 640. A DATAMATRIX barcode cannot be printed in that mode. Similarly, label 620 is printed using a second template of enforced disabled regions here defined as two white bands 630. In this case, a three line text address label may be utilized with three lines of text 640. As can be appreciated, the DATAMATRIX barcode cannot be printed in that space due to the white bands. Here the white bands are approximately 5 elements wide, but other configurations may be used.

The controlling program may allow a user to select between available templates such as those used in labels 610 and 620 or may instead rely upon the authenticated non-secure application program to create a non-secure image with sufficient disabled regions to defeat the printing of a valid value mark such as the DATAMATRIX barcode. Accordingly, the application may package the enforced disabled region data with the label data. As described above, the white regions or in an illustrative embodiment, the more specific implementation of white bands may be implemented by disabling certain heating elements or by filling those regions of the print image buffer with zero values.

Figure 6B:
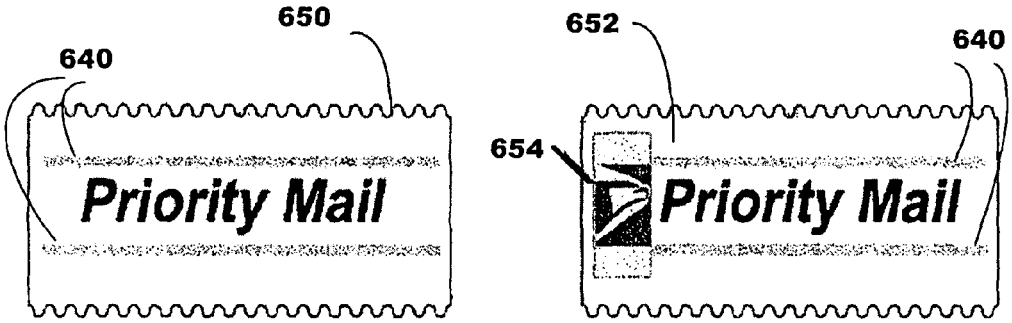
FIG. 6B is a top plan view of two media labels each including enforced white zones and one including a enforced narrow graphic zone, both labels printed in a non-secure mode according to an illustrative embodiment of the present application.

Referring to FIG. 6B, a top plan view of two media labels 650, 652 each including enforced white zones 630 and one including a enforced narrow graphic zone 654, both labels printed in a non-secure mode according to an illustrative embodiment of the present application is shown. As shown in label 650, another template of disabled regions is shown having two enforced white bands 630 allowing a larger text region. In label 652, another template is shown having two white bands 630 that do not cover the entire label. In narrow region 654, a full graphic image is permitted without the white bands because a DATAMATRIX barcode could not fit in that narrow space. In this case, the small zone for graphics can be permitted so long as the allowed graphic zone in the non-secure mode is sufficiently smaller than the minimum space required for a valid value mark such as a legible DATAMATRIX barcode and the permitted graphic region 654 is sufficiently close to enforced disabled regions such as the white bands 630.

Figure 6C:
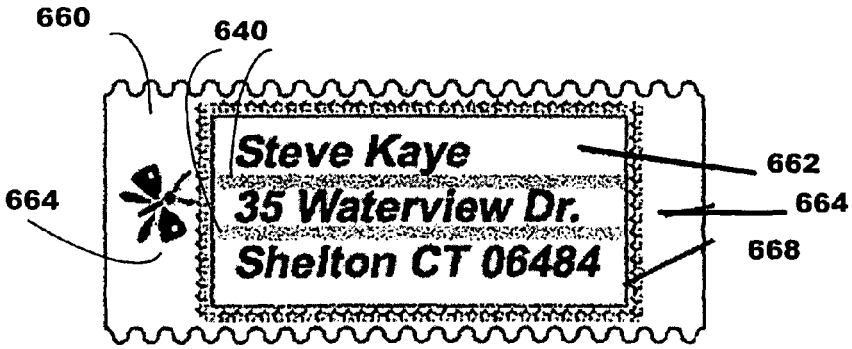
FIG. 6C is a top plan view of one media label including enforced white zones and two enforced narrow graphics zones printed in a non-secure mode according to an illustrative embodiment of the present application.

Referring to FIG. 6C, a top plan view of one media label 660 including enforced white zones 630 and two enforced narrow graphics zones 664 and having a border 668 and text region 662 printed in a non-secure mode according to an illustrative embodiment of the present application is shown. The idea of a permitted graphic zone can be extended to include a graphical border around the enforced text address area, again with the provision that the graphic areas are sufficiently small and sufficiently close to the enforced disabled regions such as enforced white band regions.

The labels described above are suitable for use with various direct thermal printers. For example, a thermal printer incorporating the Kyocera KSB320BA printhead available from Kyocera Industrial Ceramics Corp. of Vancouver, Wash. may be utilized. Furthermore, the STAMPEXPRESSIONS printer from Pitney Bowes Inc. of Stamford, Conn. may be utilized.

Figure 7:
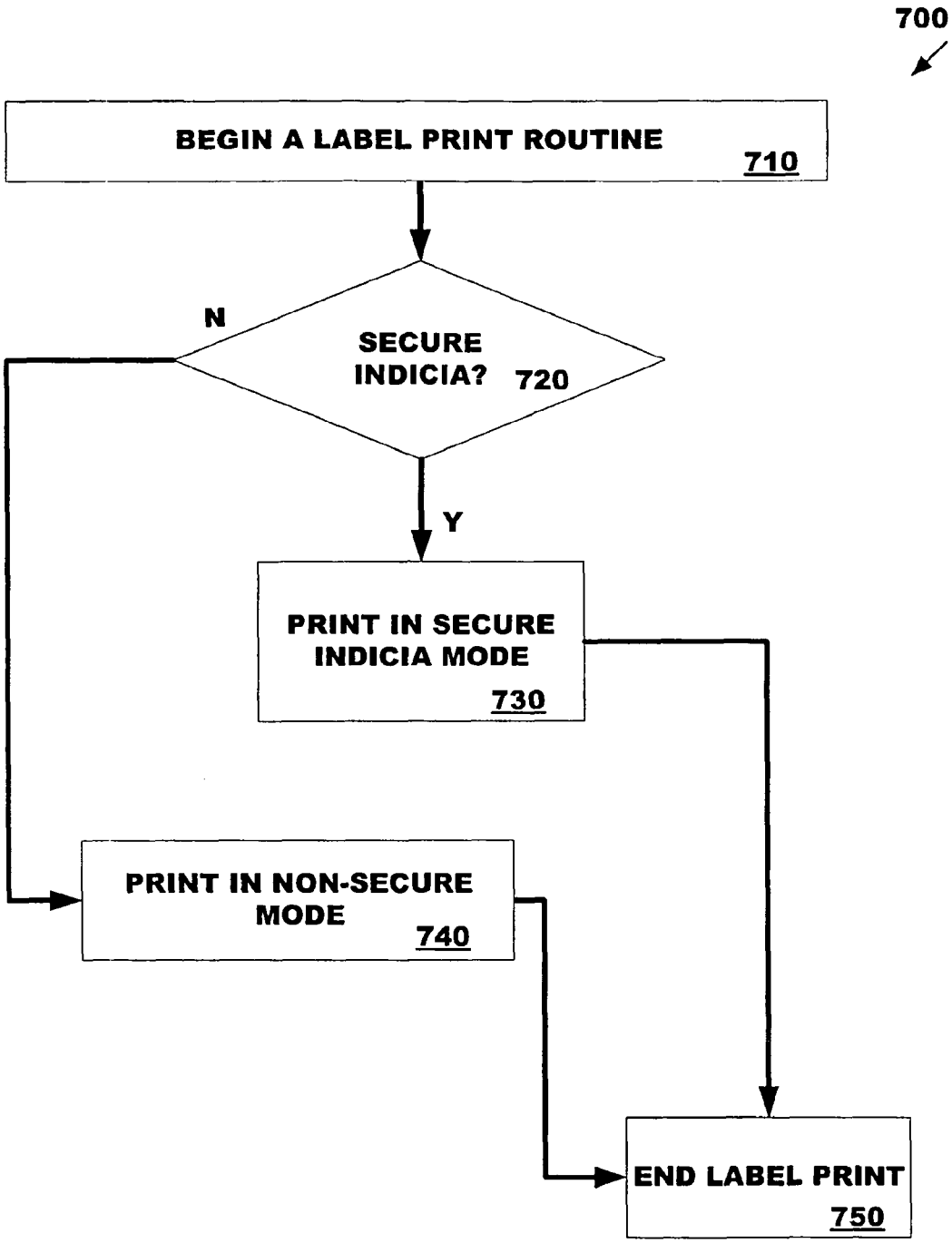
FIG. 7 is a schematic diagram of a process for printing in either a secure mode or a non-secure mode according to an illustrative embodiment of the present application.

Referring to FIG. 7, a schematic diagram of a process for printing in either a secure mode or a non-secure mode 700 according to an illustrative embodiment of the present application is shown. In step 710, the system begins a label print routine. In step 720, the process decides whether it is printing a secure postage indicium label. As explained above, if the printer is used in stand alone mode, the secure mode is the only mode of printing permitted. If the printer is connected to an external application, one or more methods described may be used to determine if the system is in secure or non-secure mode. If the system is in secure mode, the process proceeds to step 730 and a secure print is completed and the process ends in 750. If the printer is in non-secure mode, the process proceeds to step 740 to complete the non-secure print and then ends in step 750. As described above, the non-secure print may entail the user selection of a non-secure template. Alternatively, the controller may decide which template if any is appropriate and create an error condition if no appropriate template is available.

Commonly-owned, co-pending U.S. patent application Ser. No. 11/172,182, filed Jun. 30, 2005 and entitled Control Panel Label For A Postage Printing Device is incorporated by reference herein in its entirety and describes systems and methods for processing customized postage that alternatively may be advantageously utilized with the systems and methods described herein. Additionally, commonly-owned, co-pending U.S. patent application Ser. No. 11/016,493, filed Dec. 17, 2004 and entitled, Thermal Printer Temperature Management, is incorporated by reference herein in its entirety and describes certain thermal printers that alternatively may advantageously be utilized with the systems and methods described herein. Furthermore, commonly-owned, co-pending U.S. patent application Ser. No. 11/018,707, filed Dec. 21, 2004 and entitled, Label Stock For Thermal Printer, is incorporated by reference herein in its entirety and describes certain thermal printer label stock that alternatively may advantageously be utilized with the systems and methods described herein. Commonly-owned, co-pending U.S. patent application Ser. No. 11/415,307, filed May 1, 2006 and entitled Apparatus and Materials for Two-Stage Printing of Value Indicia is incorporated by reference herein in its entirety and describes systems and methods for processing customized postage that alternatively may be advantageously utilized with the systems and methods described herein. Commonly-owned, co-pending U.S. patent application Ser. No. 11/479,739, filed Jun. 30, 2006 and entitled "Signaling labels and fluorescent ink compositions" is incorporated by reference herein in its entirety and describes methods and systems that alternatively may advantageously be utilized with the systems and methods described herein.

In an alternative applicable to any of the embodiments herein, the printing technology utilized may be replaced including replacing the direct thermal technology described with inkjet, bubble jet, LED, laser, ribbon thermal, dye sub or other appropriate printing technology. For example, the embodiments may instead use a modified DM series postage meter available from PITNEY BOWES of Stamford Conn. configured to use ink jet printing and nozzles.

While several illustrative embodiments of the invention have been described and illustrated above, it should be understood that these are exemplary of the invention and are not to be considered as limiting. The embodiments are illustrative and not intended to present an exhaustive list of possible configurations. Where alternative elements are described, they are understood to fully describe alternative embodiments without repeating common elements whether or not expressly stated to so relate. Similarly, alternatives described for elements used in more than one embodiment are understood to describe alternative embodiments for each of the described embodiments having that element. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A secure value printer for printing an image comprising:

a printing subsystem having a plurality of printhead elements; and a controller that determines if the image is from an authenticated application or a non-authenticated application running on a processing device coupled to the secure value printer, enables all of the plurality of printhead elements during printing of the image if the image is from an authenticated application, and disables at least a portion of the plurality of printhead elements during printing of the image if the image is from a non-authenticated application to prevent a portion of the image from being readable when the image is completely printed.

2. The printer of claim 1, wherein the image is a postal indicium that includes a two-dimensional barcode, and the portion of the image that is prevented from being readable corresponds to an area that includes the two-dimensional barcode.

3. The printer of claim 1, wherein the controller includes:

a memory device configured for holding a print buffer including at least some of the image to be printed, and wherein the at least a portion of the plurality of printhead elements are disabled by filling a corresponding portion of the print buffer with a disabling value.

4. The printer of claim 3, wherein the disabling value of the print buffer fills at least two distinct band portions of the print buffer.

5. The printer of claim 4, wherein the at least two distinct band portions of the print buffer extends across the entire image.

6. A method for a secure value printer having a plurality of printhead elements to print an image, the method comprising:

determining, by a controller of the secure value printer, if the image is from an authenticated application or a non-authenticated application running on a processing device coupled to the secure value printer;

enabling, by the controller, all of the plurality of printhead elements during printing of the image if the image is from an authenticated application; and disabling, by the controller at least a portion of the plurality of printhead elements during printing of the image if the image is from a non-authenticated application to prevent a portion of the image from being readable when the image is completely printed.

7. The method of claim 6, wherein the image is a postal indicium that includes a two-dimensional barcode, and the portion of the image that is prevented from being readable corresponds to an area that includes the two-dimensional barcode.

8. The method of claim 6, wherein the secure value printer includes a memory configured for holding a print buffer including at least some of the image to be printed, and disabling at least a portion of the plurality of printhead elements during printing of the image further comprises:

filling a portion of the print buffer that corresponds to the at least a portion of the plurality of printhead elements with a disabling value.

9. The method of claim 8, further comprising:

filling at least two distinct band portions of the print buffer with a disabling value.

10. The method of claim 9, further comprising:

filling at least two distinct band portions of the print buffer across the entire image with a disabling value.

* * * * *